US009078554B2

(12) United States Patent
Thiyagarajan

(10) Patent No.: US 9,078,554 B2
(45) Date of Patent: Jul. 14, 2015

(54) DISHWASHER APPLIANCE WITH OZONE LEVEL MONITORING

(75) Inventor: Ramasamy Thiyagarajan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 758 days.

(21) Appl. No.: 13/348,002

(22) Filed: Jan. 11, 2012

(65) Prior Publication Data

US 2013/0174871 A1 Jul. 11, 2013

(51) Int. Cl.

| | |
|---|---|
| ***B08B 3/00*** | (2006.01) |
| ***B08B 3/02*** | (2006.01) |
| ***B08B 7/00*** | (2006.01) |
| ***B08B 7/04*** | (2006.01) |
| ***A47L 15/42*** | (2006.01) |

(52) U.S. Cl.

CPC ..... *A47L 15/424* (2013.01); *A47L 15/4219* (2013.01); *A47L 15/4276* (2013.01); *A47L 2401/20* (2013.01); *A47L 2401/34* (2013.01); *A47L 2501/05* (2013.01); *A47L 2501/06* (2013.01); *A47L 2501/11* (2013.01); *A47L 2501/12* (2013.01); *A47L 2501/16* (2013.01)

(58) Field of Classification Search

CPC ..... A47L 15/424; A47L 15/4276; A47L 15/4219; A47L 2401/20; A47L 2501/16; A47L 2501/05; A47L 2501/06; A47L 2501/11; A47L 2501/12; A47L 2401/34

USPC ..... 134/25.2, 26, 30, 18, 57 D, 56 D, 58 D

See application file for complete search history.

(56) References Cited

U.S. PATENT DOCUMENTS

| | | | | |
|---|---|---|---|---|
| 2002/0130091 | A1* | 9/2002 | Ekberg et al. | 210/760 |
| 2005/0125911 | A1* | 6/2005 | Eiermann et al. | 8/158 |
| 2006/0096038 | A1* | 5/2006 | Daniels et al. | 8/158 |
| 2007/0251549 | A1* | 11/2007 | Heiligenmann et al. | 134/31 |
| 2007/0277855 | A1* | 12/2007 | DiPanni | 134/25.3 |
| 2007/0295361 | A1* | 12/2007 | Thiyagarajan et al. | 134/18 |
| 2008/0159907 | A1* | 7/2008 | Joshi et al. | 422/5 |
| 2009/0199874 | A1* | 8/2009 | Fletcher et al. | 134/25.2 |
| 2010/0000577 | A1* | 1/2010 | Heiligenmann et al. | 134/22.11 |
| 2011/0002810 | A1* | 1/2011 | Watson et al. | 422/5 |
| 2011/0203620 | A1* | 8/2011 | Ulger et al. | 134/184 |
| 2012/0070352 | A1* | 3/2012 | Eglmeier et al. | 423/219 |
| 2012/0291816 | A1* | 11/2012 | Heiligenmann et al. | 134/25.2 |
| 2014/0196752 | A1* | 7/2014 | Aras et al. | 134/102.1 |

FOREIGN PATENT DOCUMENTS

| | | | |
|---|---|---|---|
| EP | 1332709 | A1 * | 8/2003 |
| WO | WO 2010-049318 | A1 | 5/2010 |

* cited by examiner

*Primary Examiner* — Alexander Markoff

(74) *Attorney, Agent, or Firm* — Dority & Manning, P.A.

(57) ABSTRACT

The present subject matter provides a dishwasher appliance that measures the amount of ozone in a wash chamber of the appliance. The appliance is also configured for adjusting the amount of ozone in the wash chamber based upon such measurements. The appliance may adjust the amount of ozone by, e.g., adjusting the flow rate of wash fluid to the wash chamber, adjusting the flow rate of air in the wash chamber, and/or adjusting the temperature of wash chamber. Related methods are also provided.

19 Claims, 6 Drawing Sheets

DISHWASHER APPLIANCE WITH OZONE LEVEL MONITORING

FIELD OF THE INVENTION

The present subject matter relates generally to a dishwasher appliance with features for monitoring the amount of ozone in a wash chamber of the appliance and related methods.

BACKGROUND OF THE INVENTION

Dishwasher appliances clean dishes disposed therein using a washing fluid (e.g., water and detergent) to remove debris and stains from the dishes. Thereafter, the dishes are rinsed with water to remove the washing fluid. After rinsing, the dishes can be dried by the dishwasher appliance, e.g., to avoid streaking or spotting on the dishes.

A design goal for current dishwasher appliances is to operate efficiently and hygienically. To further this goal, a dishwasher appliance can utilize ozone to increase efficiency and hygiene. For example, during a wash or rinse cycle, ozone can be introduced into a wash fluid circulating through the appliance. The ozone can improve efficiency by decreasing the amount of thermal energy needed to clean articles being washed. During a drying cycle, ozone in the appliances' wash chamber can sanitize articles by eliminating certain germs. Further, the ozone can eliminate unpleasant odors caused by certain molds.

Ozone levels are regulated by several federal agencies including the FDA, EPA, and OSHA. Dishwasher appliances that utilize ozone should maintain ozone within certain levels in order to ensure compliance with relevant regulations.

Accordingly, a dishwasher appliance that can use ozone to assist with properly cleaning articles such as dishes and other cooking utensils would be useful. Such an appliance that can monitor the amount of ozone in a wash chamber of the appliance would be useful. A dishwasher appliance that can also take one or more actions to control the amount of ozone in the appliance would be particularly useful

BRIEF DESCRIPTION OF THE INVENTION

Aspects and advantages of the invention will be set forth in part in the following description, or may be obvious from the description, or may be learned through practice of the invention.

In a first embodiment, a dishwasher appliance is provided. The dishwasher appliance has a cabinet with a wash chamber. A rack assembly is slidably received into the wash chamber and configured for receipt of articles for cleaning. A spray arm assembly applies a fluid to the articles in said rack assembly. A pump is in fluid communication with the spray arm assembly. The pump is configured for selective delivery of the fluid to the spray arm assembly. An ozone generator is also in fluid communication with the spray arm assembly. The ozone generator is configured for selective generation of ozone. An ozone sensor is configured for measuring an amount of ozone in the wash chamber of the cabinet. A processing device is in communication with the pump, the ozone generator, and the ozone sensor. The processing device is configured for activating the pump in order to initiate a flow of fluid to the spray arm assembly, operating the ozone generator in order to introduce ozone into the flow of fluid to the spray arm assembly, conducting a measurement of the amount of ozone in the wash chamber of the cabinet with the ozone sensor, comparing the measurement of the amount of ozone from the step of conducting to a predetermined value, and adjusting the pump in order to modify the flow rate of the flow of fluid to the spray arm assembly at least in part in response to determining that the measurement of the amount of ozone is approaching the predetermined value.

In a second embodiment, a dishwasher appliance is provided. The dishwasher appliance includes a cabinet having a wash chamber. A rack assembly is slidably received into the wash chamber and configured for receipt of articles for cleaning. A spray arm assembly applies a fluid to the articles in the rack assembly. A fan is in fluid communication with the wash chamber of the cabinet. An ozone sensor is configured for measuring an amount of ozone in the wash chamber of the cabinet. A processing device is in communication with the fan and the ozone sensor. The processing device is configured for activating the fan in order to initiate a flow of air in the wash chamber, conducting a measurement of the amount of ozone in the wash chamber of the cabinet with the ozone sensor, comparing the measurement of the amount of ozone from the step of conducting to a predetermined value, and adjusting the fan in order to modify the flow rate of the flow of air in the wash chamber at least in part in response to determining that the measurement of the amount of ozone is approaching than the predetermined value.

In a third embodiment, a method for operating a dishwasher appliance is provided. The method includes filling a sump of a dishwasher appliance with a fluid, pumping the fluid to a spray arm assembly of the dishwasher appliance, injecting ozone into the fluid from the step of pumping, measuring the amount of ozone within a wash chamber of the dishwasher appliance, comparing the amount of ozone from the step of measuring to a predetermined value, and adjusting a flow rate of the fluid to the spray arm assembly at least in part in response to determining that the measurement of the amount of ozone is approaching than the predetermined value.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
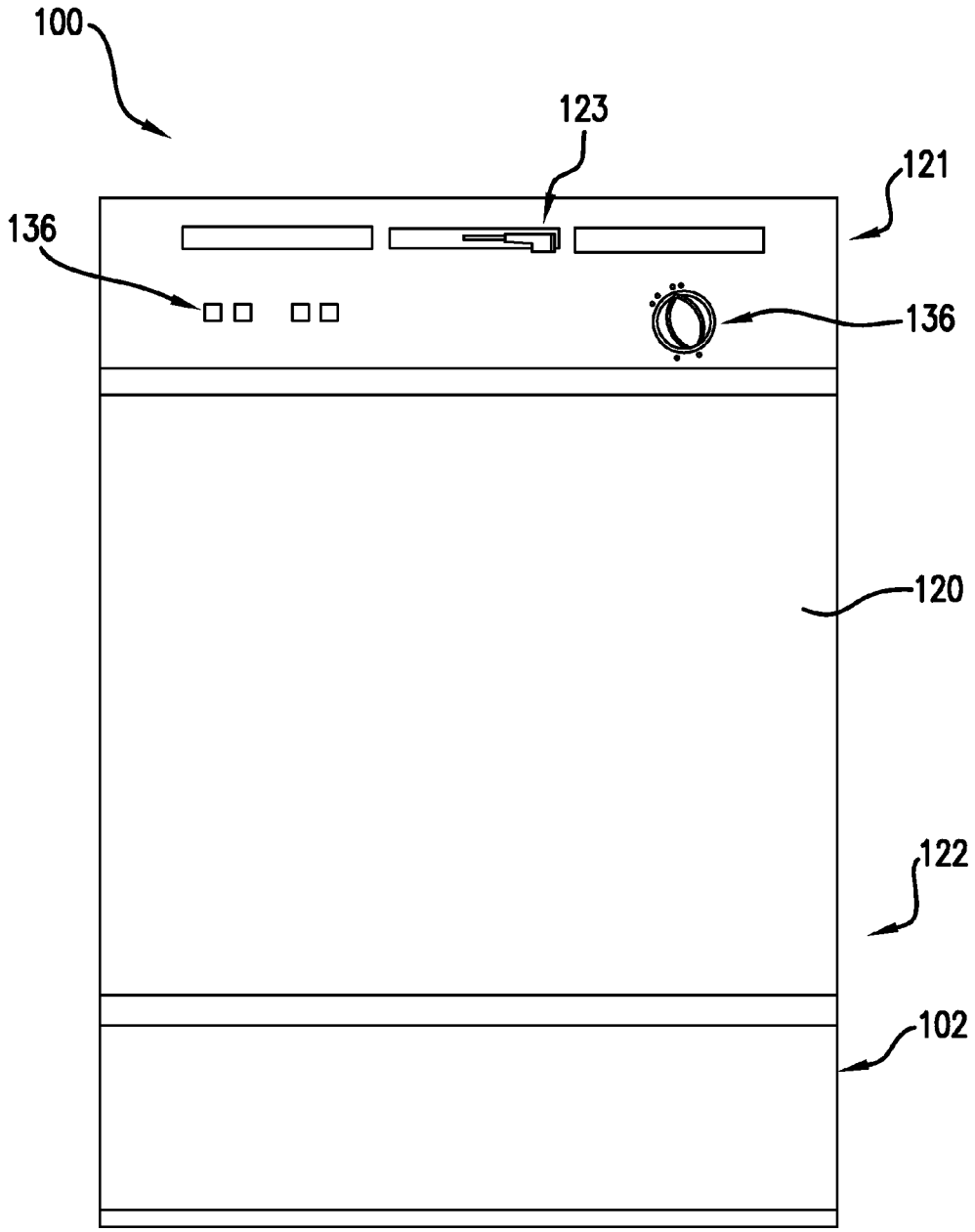
FIG. 1 provides a front view of a dishwasher appliance according to an exemplary embodiment of the present subject matter.

The present subject matter provides a dishwasher appliance that measures the amount of ozone in a wash chamber of the appliance. The appliance is also configured for adjusting the amount of ozone in the wash chamber based upon such measurements. The appliance may adjust the amount of ozone by, e.g., adjusting the flow rate of wash fluid to the wash chamber, adjusting the flow rate of air in the wash chamber, and/or adjusting the temperature of wash chamber. Related methods are also provided. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
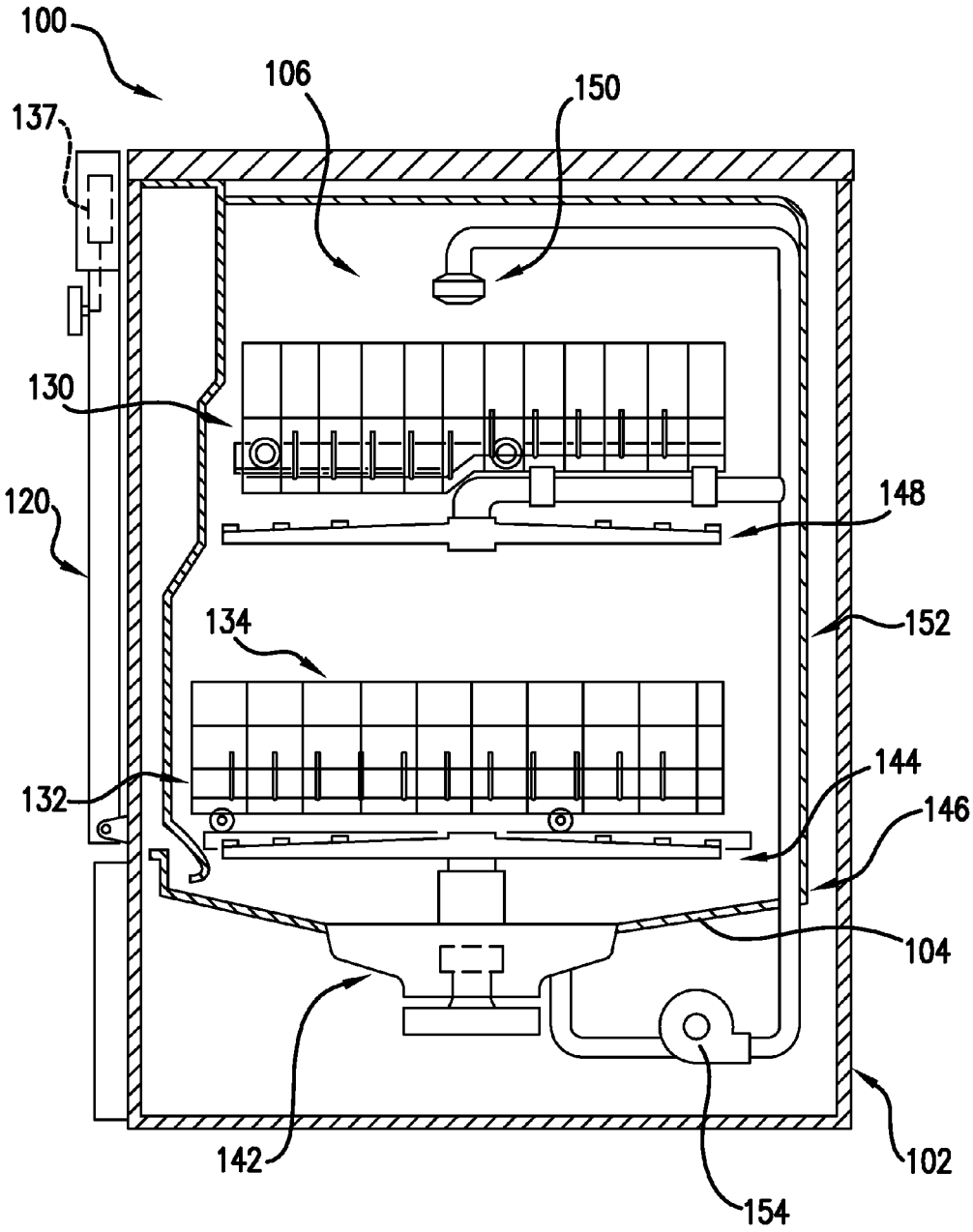
FIG. 2 provides a cross-sectional view of the dishwasher appliance of FIG. 1, a wash chamber of the appliance is also shown.

FIGS. 1 and 2 depict an exemplary domestic dishwasher appliance 100 that may be configured in accordance with aspects of the present disclosure. For the particular embodiment of FIG. 1, the dishwasher 100 includes a cabinet 102. The cabinet 102 has a tub 104 therein that defines a wash chamber 106. The tub 104 includes a front opening (not shown) and a door 120 hinged at its bottom 122 for movement between a normally closed, vertical position (shown in FIGS. 1 and 2), wherein the wash chamber 106 is sealed shut for washing operation, and a horizontal, open position for loading and unloading of articles from the dishwasher. Latch 123 is used to lock and unlock door 120 for access to chamber 106.

Rack assemblies 130 and 132 are slidably mounted within the wash chamber 106. Each of the rack assemblies 130, 132 is fabricated into lattice structures from a plurality of elongated members 134. Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

The lower and mid-level spray-arm assemblies 144, 148 and the upper spray assembly 150 are fed by a fluid circulation assembly 152 for circulating water and/or wash fluid in the tub 104. The fluid circulation assembly 152 may include a circulation pump 154 located in a machinery compartment 140 located below the bottom sump portion 142 of the tub 104, as generally recognized in the art. Each spray-arm assembly 144, 148 includes an arrangement of discharge ports or orifices for directing wash fluid onto dishes or other articles located in rack assemblies 130 and 132. The arrangement of the discharge ports in spray-arm assemblies 144, 148 provides a rotational force by virtue of wash fluid flowing through the discharge ports. The resultant rotation of the lower spray-arm assembly 144 provides coverage of dishes and other dishwasher contents with the wash fluid.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electromechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher, and that the embodiment depicted in FIGS. 1 and 2 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles. Other configurations may be used as well.

Figure 3:
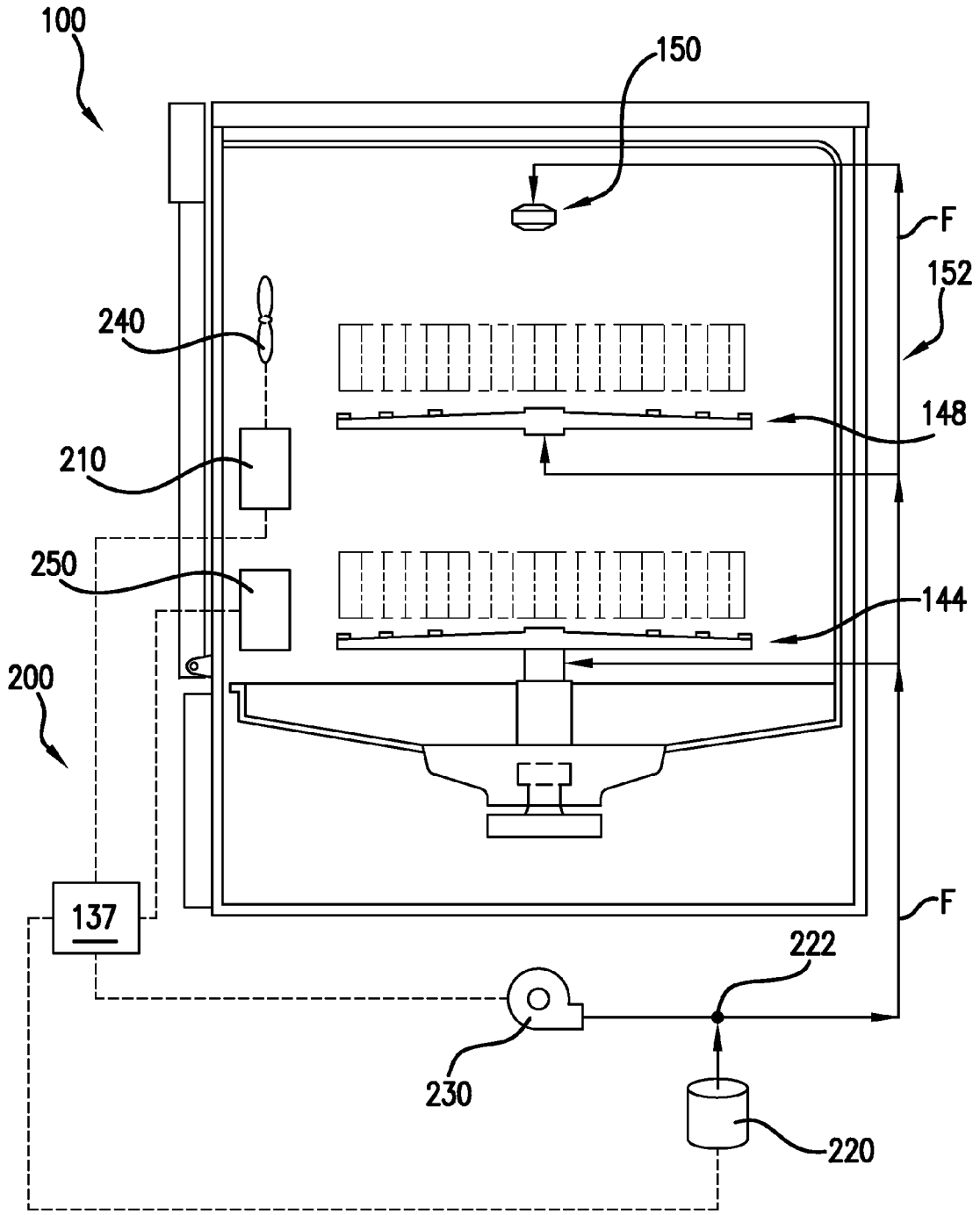
FIG. 3 illustrates a schematic representation of an exemplary ozone injection and monitoring system for the dishwasher appliance of FIG. 1 during a wash cycle of the dishwasher appliance.
Figure 4:
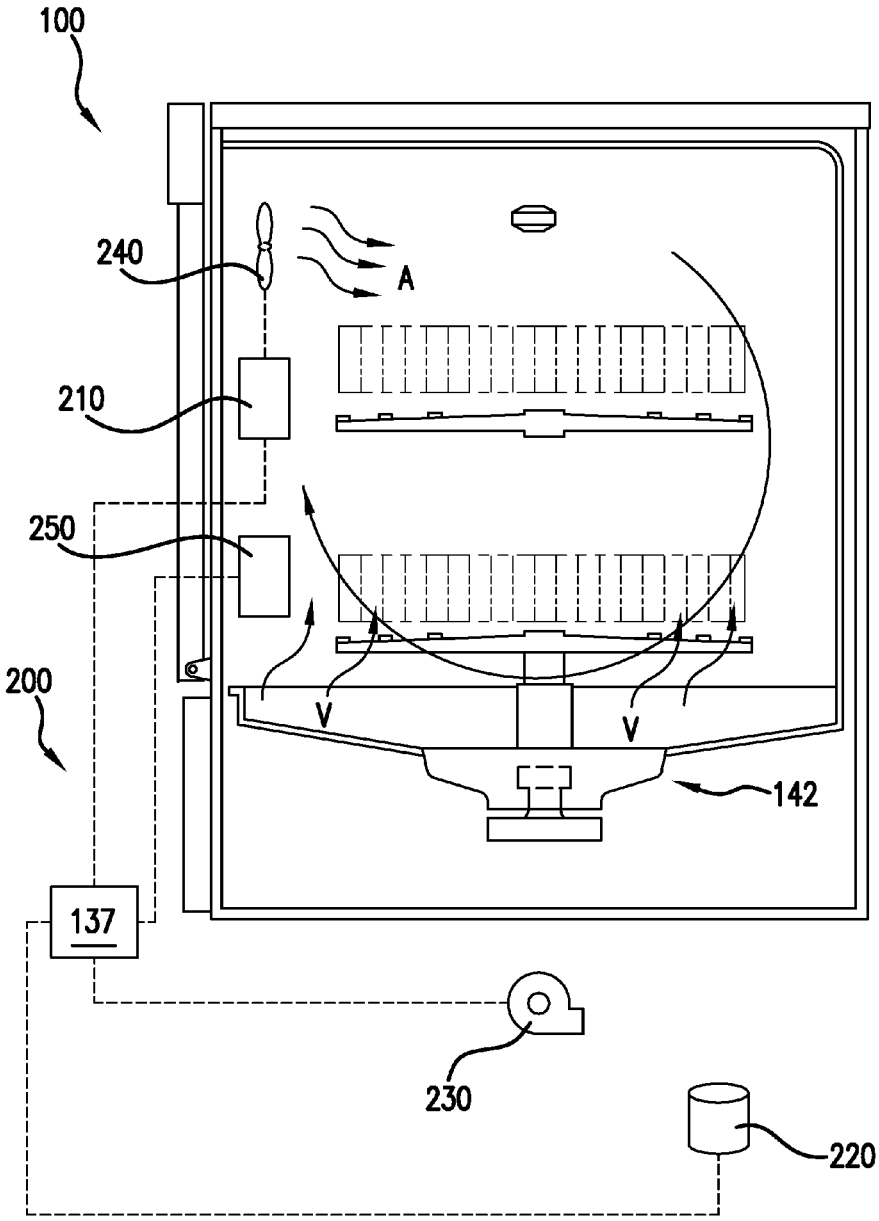
FIG. 4 illustrates a schematic representation of the ozone injection and monitoring system shown in FIG. 3 during a drying cycle of the dishwasher appliance.

FIGS. 3 and 4 illustrate schematic representations of an ozone injection and monitoring system 200 of dishwasher appliance 100 of FIG. 1. In FIG. 3, ozone system 200 is shown in a wash or rinse cycle of dishwasher appliance 100. In FIG. 4, ozone system 200 is shown in a drying cycle of dishwasher appliance 100.

As may be seen in FIG. 3, ozone system 200 includes a pump 230. Pump 230 may be, e.g., circulation pump 154 shown in FIG. 2, a separate pump that is independent of circulation pump 154, or any other suitable pump. Pump 230 is in communication with lower, mid-level, and upper spray arm assemblies 144,148,150. Thus, pump 230 is configured for producing a flow of fluid F to lower, mid-level, and upper spray arm assemblies 144,148,150, e.g., via fluid circulation assembly 152. Pump 230 is also in fluid communication with an ozone generator 220. Ozone generator 220 is configured for producing ozone. Ozone generator 220 may be, e.g., a corona discharge ozone generator, an ultraviolet ozone generator, an electrolytic ozone generator, or any other suitable ozone generator. Ozone produced by ozone generator 220 is delivered into the flow of fluid F. Ozone from ozone generator 220 may be mixed with flow of fluid F, e.g., using a Venturi injector 222, in order to ozonize the flow of fluid F. Other techniques for introducing ozone into fluid F may be used as well.

Ozone system 200 also includes an ozone sensor 210 disposed in wash chamber 106. Ozone sensor 210 is configured for measuring the amount of ozone in wash chamber 106. Also, ozone system 200 includes a fan 240 disposed in wash chamber 106. Fan 240 is configured for selectively initiating a flow of air (shown with arrows A in FIG. 4) in wash chamber 106. Ozone system 200 also includes a heater 250. Heater 250 is disposed in wash chamber 106 and is configured for selectively adjusting a temperature of wash chamber 106. Heater 250 can be located in sump 142 of wash chamber 106 for heating fluid located in sump 142. Alternatively, heater 250 could be located above sump 142 to heat air in wash chamber 106. Combinations thereof may be used as well.

Controller 137 is configured to receive signals from and is in communication with ozone sensor 210, ozone generator 220, pump 230, fan 240, and heater 250. As discussed above, controller 137 regulates operation of dishwasher 100. Thus, controller 137 regulates operation of ozone sensor 210, ozone generator 220, pump 230, fan 240, and heater 250 as discussed in more detail below.

In FIG. 3, dishwasher appliance 100 is in the wash or rinse cycle. Pump 230 is delivering fluid to lower, mid-level, and upper spray arm assemblies 144,148,150, and ozone generator is delivering ozone to flow of fluid F. Thus, flow of fluid F is ozonized, and ozone is delivered to wash chamber 106. In FIG. 4, dishwasher appliance 100 is in the drying cycle. Ozonized fluid in sump 142 releases ozonized vapor (shown with arrows V) into air of wash chamber 106. Fan 240 operates to initiate a flow of air (shown with arrows A) in wash chamber 106 and, e.g., circulate ozone released by ozonized vapor V in sump 142. Thus, the operation of fan 240 increases the amount of ozone that is released from ozonized fluid in sump 142. Additionally, the operation of heater 250 to heat ozonized fluid in sump 142 will further increase the amount of ozone released from the ozonized fluid.

Figure 5:
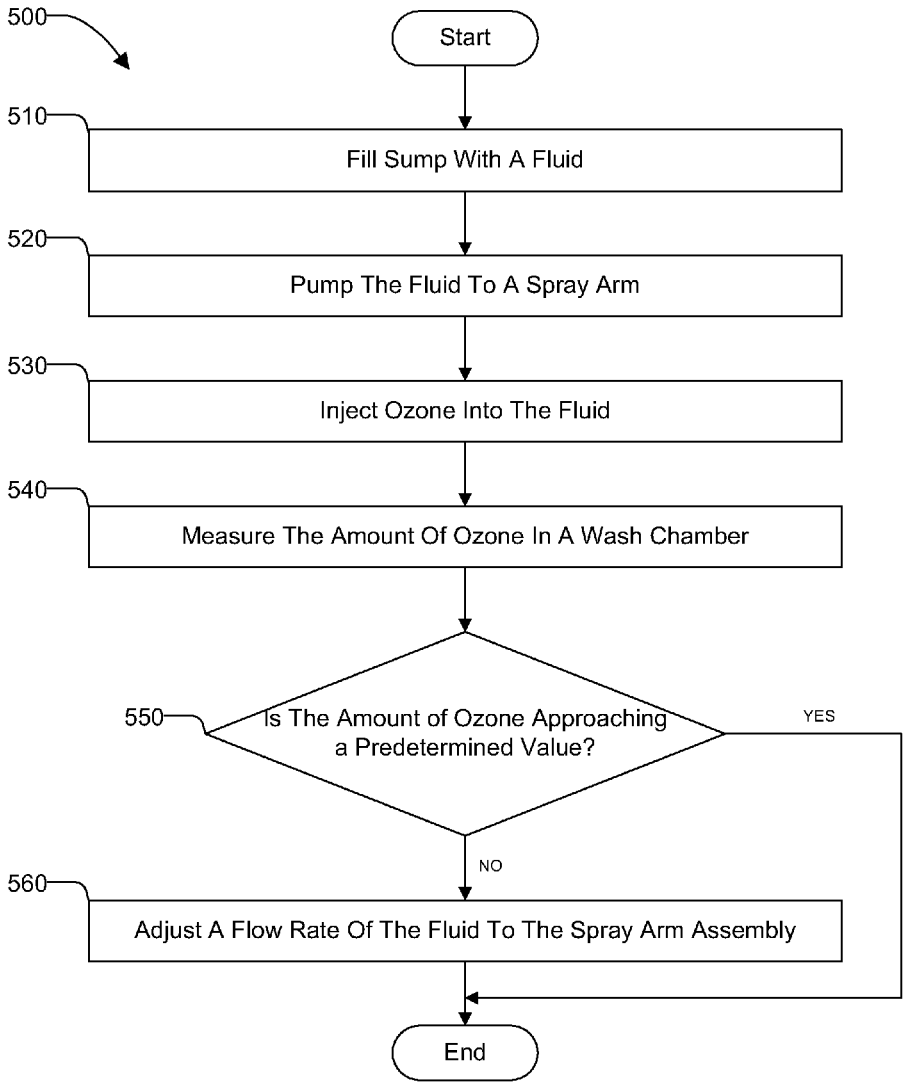
FIG. 5 provides a flow chart for an exemplary method of operating a dishwasher appliance in order to control the amount of ozone in a wash chamber of the appliance during a washing or rinsing cycle of the appliance.
Figure 6:
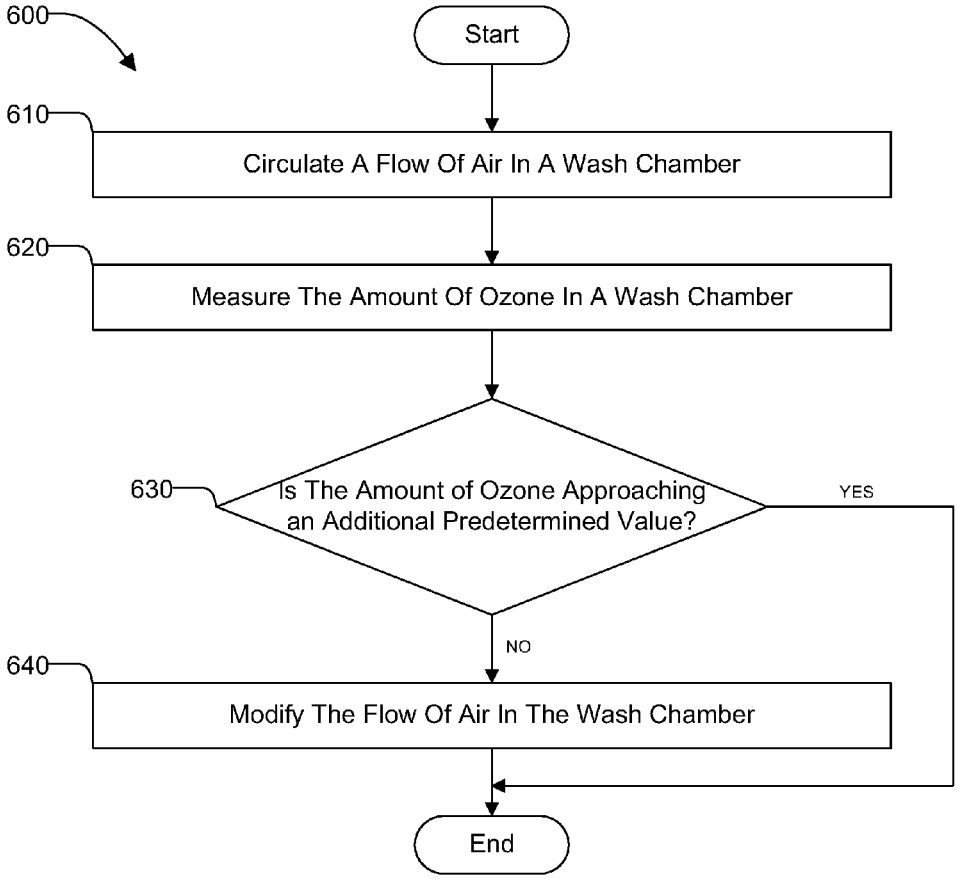
FIG. 6 provides a flow chart for an exemplary method of operating a dishwasher appliance in order to control the amount of ozone in a wash chamber of the appliance during a drying cycle of the appliance.

FIGS. 5 and 6 provide methods 500, 600 of operating dishwasher appliances (e.g., dishwasher appliance 100 of FIG. 1). The methods 500, 600 shown in FIGS. 5 and 6 may be carried out, e.g., by controller 137 of dishwasher appliance 100. Thus, controller 137 may be programmed to carry out steps of methods 500, 600. FIG. 5 illustrates a method 500 of operating dishwasher appliance 100 during a wash or rinse cycle of dishwasher appliance 100.

At step 510, sump 142 of dishwasher appliance 100 is filled with a fluid. For example, sump 142 may be filled with detergent and/or tap water from a water source. Depending on the particular cycle on which dishwasher appliance 100 is operating, the mix of detergent and/or water in fluid may vary. Also, it should be understood that filling sump 142 with fluid means providing an amount of fluid necessary to complete any particular cycle of dishwasher appliance 100. For example, the amount of fluid required to complete a wash cycle of dishwasher appliance 100 may be different than the amount of fluid required to complete a rinse cycle of dishwasher appliance 100. Thus, no particular amount of fluid is necessary to complete this step.

As step 520, the fluid is pumped to a spray arm assembly (e.g., lower, middle, or upper spray arm assemblies 144, 148, or 150) generating flow of fluid F. The fluid may be pumped to spray arm assembly, e.g., using pump 230 or circulation pump 154. Thus, controller 137 may activate pump 230 or circulation pump 154 in order to begin pumping fluid to lower, middle, and upper spray arm assemblies 144,148,150. By pumping fluid to spray arm assembly, articles in wash chamber 106 of dishwasher appliance 100 may be washed and/or rinsed.

At step 530, ozone is injected into the fluid. For example, controller 137 may send a signal to ozone generator 220 in order to activate ozone generator 220. In turn, ozone generator 220 may inject (e.g., using Venturi injector 222) ozone into flow of fluid F being pumped by pump 230 to spray arm assemblies 144,148,150. However, it should be understood that ozone may be injected into the fluid using any other suitable means or mechanism. By injecting ozone into the fluid, the amount of energy needed to wash and/or rinse articles in wash chamber 106 may be reduced because the ozone can accelerate the cleaning process. For example, the fluid temperature required for washing and/or rinsing articles in wash chamber may be reduced by adding ozone to the fluid. Also, the ozone may sanitize the articles by assisting in eliminating certain germs and/or molds.

At step 540, the amount of ozone in wash chamber 106 is measured. For example, ozone sensor 210 may be used to measure amount of ozone in wash chamber 106. Thus, controller 137 may receive a signal (e.g., a voltage or current) from ozone sensor 210 that corresponds to the amount of ozone in wash chamber 106. Measuring the amount of ozone in wash chamber 106 may be necessary to comply with certain regulations. For example, under certain regulations, concentrations of ozone are not permitted to exceed a particular threshold.

As step 550, the measurement of the amount of ozone in wash chamber 106 is compared to a predetermined value in order to determine if the amount of ozone in wash chamber 106 is approaching the predetermined value. The predetermined value may correspond to a maximum acceptable amount of ozone. For example, ozone levels that exceed the predetermined value may exceed regulatory limits on the amount of ozone. Thus, controller 137 may compare the measurement of the amount of ozone (e.g., the measurement received from ozone sensor 210 at step 540) to the predetermined value. For example, the predetermined value may be 0.075 ppm. Alternatively, the predetermined value may also correspond to a minimum acceptable amount of ozone. For example, a certain threshold of ozone may be required for proper sanitization of articles in wash chamber 106. Thus, ozone levels that fall below the predetermined threshold may be insufficient to properly sanitize the articles.

When the ozone level in wash chamber 106 is approaching or reaches the predetermined value, the ozone level in wash chamber 106 may require adjustment. Thus, at 560, a flow rate of the fluid to the spray arm assembly is adjusted at least in part in response to determining that the measurement of the amount of ozone is approaching the predetermined value. At 560, controller 137 may adjust pump 230 or circulation pump 154 in order to adjust flow rate of fluid to lower, middle, and upper spray arm assemblies 144,148,150. By adjusting flow rate of fluid to the spray arm assembly, the amount of ozone in wash chamber 106 may be adjusted. For example, because ozone is introduced into fluid pumped by pump 230 to spray arm assemblies 144,148,150, by decreasing the flow rate of fluid, the amount of ozone in wash chamber 106 is decreased as well. Similarly, should the amount of ozone in wash chamber 106 be too low, increasing the flow rate of fluid will increase the amount of ozone in wash chamber 106.

In addition, to adjusting the flow rate of fluid to the spray arm assembly, additional steps may be taken to adjust the amount of ozone in wash chamber 106. For example, the temperature of wash chamber 106 may be modified in order to adjust the amount of ozone in wash chamber 106. Thus, controller 137 may activate heater 250 in order to modify the temperature of wash chamber 106. Controller 137 may activate heater 250 at least in part in response to determining that the measurement of the amount of ozone is less than the predetermined value.

After a period of time, flow of fluid F to the spray arm assembly may be terminated, e.g., when wash or rinse cycle of dishwasher appliance 100 is complete. For example, controller 137 may signal pump 230 or circulation pump 154 to deactivate in order to terminate flow of fluid F. As discussed in more detail below, after completion of wash or rinse cycle and termination of flow of fluid F, a drying cycle may be initiated. During the drying cycle, as shown in FIG. 4, ozonized fluid may remain in sump 142 and release ozonized vapor (shown with arrows V). Such ionized vapor V may be utilized during drying cycle in order to, e.g., sanitize articles in wash chamber 106.

FIG. 6 illustrates a method 600 of operating dishwasher appliance 100 during the drying cycle of dishwasher appliance 100. At 610, the method 600 includes circulating a flow of air A in wash chamber 106 of dishwasher appliance 100. For example, controller 137 may activate fan 240 in order to initiate flow of air A. Flow of air A may, e.g., assist in drying articles in wash chamber 106 or assist in adjusting the amount of ozone in wash chamber 106, e.g., as discussed in more detail further below.

At 620, the amount of ozone in wash chamber 106 is measured. For example, ozone sensor 210 may be used to measure amount of ozone in wash chamber 106. Thus, controller 137 may receive a signal (e.g., a voltage or current) from ozone sensor 210 that corresponds to the amount of ozone in wash chamber 106. Like above, measuring the amount of ozone in wash chamber 106 may be necessary to comply with certain regulations.

As 630, the measurement of the amount of ozone in wash chamber 106 is compared to an additional predetermined value. The additional predetermined value, like the predetermined value, may correspond to a maximum acceptable amount of ozone. Thus, ozone levels that exceed the additional predetermined value may exceed regulatory limits on the amount of ozone. Thus, controller 137 may compare the measurement of the amount of ozone (e.g., the measurement received from ozone sensor 210 at step 620) to the additional predetermined value. For example, the additional predetermined value may be 0.075 ppm. Alternatively, the additional predetermined value may also correspond to a minimum acceptable amount of ozone. For example, a certain threshold of ozone may be required for proper sanitization of articles in wash chamber 106. Thus, ozone levels that fall below the predetermined threshold may be insufficient to properly sanitize the articles.

At 640, a flow rate of the flow of air A is modified at least in part in response to determining that the measurement of the amount of ozone is approaching or has reached the additional predetermined value. Thus, at 640, controller 137 may adjust fan 240 in order to adjust flow rate of flow of air A. By adjusting flow rate of flow of air A, the amount of ozone in wash chamber 106 may be adjusted. For example, should the amount of ozone in wash chamber 106 be too low, increasing the flow rate of flow of air A with fan 240 will increase the amount of ozone in wash chamber 106 by circulating ozone from ozonized vapor V in wash chamber 106. Similarly, by decreasing flow rate of flow of air A with fan 240, the amount of ozone in wash chamber 106 will decrease due to reduced circulation of ozonized vapor V.

In addition, to adjusting the flow rate of air A, additional steps may be taken to adjust the amount of ozone in wash chamber 106. For example, the temperature of wash chamber 106 may be modified in order to adjust the amount of ozone in wash chamber 106. For example, controller 137 may activate heater 250 at least in part in response to determining that the measurement of the amount of ozone is less than the predetermined value. By increasing temperature of wash chamber 106, amount of ozone in wash chamber 106 may increase as well due to increased ozonized vapor V.

After an additional period of time, flow of air A may be terminated, e.g., when drying cycle of dishwasher appliance 100 is complete. For example, controller 137 may signal fan 240 to deactivate in order to assist in terminating flow of air A. In addition, controller 137 may also signal, e.g., pump 230, circulation pump 154, or drain pump (not shown) in order to drain sump 142 of fluid.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a dishwasher appliance, said method comprising:

filling a sump of a dishwasher appliance with a fluid;

pumping the fluid to a spray arm assembly of the dishwasher appliance;

injecting ozone into the fluid during said step of pumping;

measuring an amount of ozone within a wash chamber of the dishwasher appliance;

comparing the amount of ozone within the wash chamber of the dishwasher appliance from said step of measuring to a predetermined value; and changing the amount of ozone within the wash chamber of the dishwasher appliance by adjusting a flow rate of the fluid to the spray arm assembly at least in part in response to determining that the amount of ozone within the wash chamber of the dishwasher appliance from said step of measuring is approaching the predetermined value.

2. The method of operating a dishwasher appliance of claim 1, further comprising adjusting a temperature of the wash chamber of the dishwasher appliance at least in part in response to determining that the amount of ozone within the wash chamber of the dishwasher appliance from said step of measuring is approaching the predetermined value.

3. The method of operating a dishwasher appliance of claim 1, further comprising terminating a flow of fluid to the spray arm assembly and injection of ozone into the fluid after a predetermined period of time has elapsed from a start of said step of injecting.

4. The method of operating a dishwasher appliance of claim 3, further comprising:

circulating a flow of air in the wash chamber of the dishwasher appliance;

performing an additional measurement of the amount of ozone in the wash chamber of the dishwasher appliance;

comparing the additional measurement of the amount of ozone in the wash chamber of the dishwasher appliance from said step of performing to an additional predetermined value; and modifying the flow of air in the wash chamber of the dishwasher appliance at least in part in response to determining that the additional measurement of the amount of ozone is approaching the additional predetermined value.

5. The method of operating a dishwasher appliance of claim 4, further comprising terminating the flow of air in the wash chamber of the dishwasher appliance after an additional predetermined period of time has elapsed from a start of said step of circulating.

6. The method of claim 1, wherein said step of changing the amount of ozone within the wash chamber of the dishwasher appliance comprises increasing a speed of a pump of the dishwasher appliance in order to increase the flow rate of the fluid to the spray arm assembly.

7. The method of claim 1, wherein said step of changing the amount of ozone within the wash chamber of the dishwasher appliance comprises decreasing a speed of a pump of the dishwasher appliance in order to increase the flow rate of the fluid to the spray arm assembly.

8. The method of claim 2, wherein said step of adjusting comprises activating a heater of the dishwasher appliance in order to increase the temperature of the wash chamber of the dishwasher appliance and the amount of ozone in the wash chamber of the dishwasher appliance.

9. The method of claim 2, wherein said step of adjusting comprises deactivating a heater of the dishwasher appliance in order to decrease the amount of ozone in the wash chamber of the dishwasher appliance.

10. The method of claim 4, wherein said step of modifying comprises increasing a speed of a fan of the dishwasher appliance in order to increase the amount of ozone in the wash chamber of the dishwasher appliance.

11. The method of claim 4, wherein said step of modifying comprises decreasing a speed of a fan of the dishwasher appliance in order to decrease the amount of ozone in the wash chamber of the dishwasher appliance.

12. A method for operating a dishwasher appliance, the method comprising:

initiating a rinse cycle of the dishwasher appliance;

operating a pump of the dishwasher appliance during the rinse cycle in order to urge a rinse fluid from a sump of the dishwasher appliance to a spray arm assembly of the dishwasher appliance;

activating an ozone generator of the dishwasher appliance during the rinse cycle in order to inject ozone into the rinse fluid;

measuring an amount of ozone within a wash chamber of the dishwasher appliance during the rinse cycle with an ozone sensor of the dishwasher appliance;

comparing a measured amount of ozone in the wash chamber of the dishwasher appliance from said step of measuring to a predetermined value with a controller of the dishwasher appliance; and changing the amount of ozone within the wash chamber of the dishwasher appliance by adjusting a speed of the pump of the dishwasher appliance during the rinse cycle if the measured amount of ozone in the wash chamber of the dishwasher appliance from said step of measuring is approaching an upper limit or a lower limit, a flow rate of the rinse fluid to the spray arm assembly changing during said step of adjusting.

13. The method of claim 12, wherein the upper limit corresponds to a maximum regulatory amount of ozone.

14. The method of claim 13, wherein the upper limit is an ozone concentration of seventy-five thousandths parts per million.

15. The method of claim 12, wherein the lower limit corresponds to a minimum amount of ozone required for proper sanitization of articles in the wash chamber of the dishwasher appliance.

16. The method of claim 12, wherein said step of changing the amount of ozone within the wash chamber of the dishwasher appliance comprises increasing the amount of ozone within the wash chamber of the dishwasher appliance by increasing the speed of the pump of the dishwasher appliance such that the flow rate of the rinse fluid to the spray arm assembly increases if the measured amount of ozone in the wash chamber of the dishwasher appliance from said step of measuring approaches the lower limit.

17. The method of claim 12, wherein said step of changing the amount of ozone within the wash chamber of the dishwasher appliance comprises decreasing the amount of ozone within the wash chamber of the dishwasher appliance by decreasing the speed of the pump of the dishwasher appliance such that the flow rate of the rinse fluid to the spray arm assembly decreases if the measured amount of ozone in the wash chamber of the dishwasher appliance from said step of measuring approaches the upper limit.

18. The method of operating a dishwasher appliance of claim 12, further comprising:

initiating a drying cycle of the dishwasher appliance after the rinse cycle of the dishwasher appliance;

circulating a flow of air in the wash chamber of the dishwasher appliance with a fan of the dishwasher appliance during the drying cycle of the dishwasher appliance;

performing an additional measurement of the amount of ozone in the wash chamber of the dishwasher appliance with the ozone sensor of the dishwasher appliance during the drying cycle of the dishwasher appliance;

comparing the add additional measurement of the amount of ozone in the wash chamber of the dishwasher appliance from said step of performing to an additional predetermined value with the controller of the dishwasher appliance; and modifying a speed of the fan of the dishwasher appliance if the additional measurement of the amount of ozone from said step of performing is approaching the additional predetermined value in order to change the amount of ozone within the wash chamber of the dishwasher appliance.

19. The method of operating a dishwasher appliance of claim 12, further comprising:

initiating a drying cycle of the dishwasher appliance after the rinse cycle of the dishwasher appliance;

performing an additional measurement of the amount of ozone in the wash chamber of the dishwasher appliance with the ozone sensor of the dishwasher appliance during the drying cycle of the dishwasher appliance;

comparing the additional measurement of the amount of ozone in the wash chamber of the dishwasher appliance from said step of performing to an additional predetermined value with the controller of the dishwasher appliance; and modifying a temperature of the wash chamber of the dishwasher appliance if the additional measurement of the amount of ozone from said step of performing is approaching the additional predetermined value in order to change the amount of ozone within the wash chamber of the dishwasher appliance.

* * * * *